US008256579B2

(12) United States Patent
Jia

(10) Patent No.: US 8,256,579 B2
(45) Date of Patent: Sep. 4, 2012

(54) ELEVATOR CAR BRAKE

(76) Inventor: Yanhua Jia, Langfang (CN)

( * ) Notice: Subject to any disclaimer, the term of this patent is extended or adjusted under 35 U.S.C. 154(b) by 475 days.

(21) Appl. No.: 12/646,052

(22) Filed: Dec. 23, 2009

(65) Prior Publication Data

US 2011/0147133 A1 Jun. 23, 2011

(51) Int. Cl.
*B66B 5/24* (2006.01)

(52) U.S. Cl. ..... 187/350; 188/65.2

(58) Field of Classification Search ..... 187/350, 187/373, 89; 188/65.1, 65.2, 188
See application file for complete search history.

(56) References Cited

U.S. PATENT DOCUMENTS

| | | | | |
|---|---|---|---|---|
| 3,690,413 | A * | 9/1972 | Airheart | 188/381 |
| 5,228,540 | A * | 7/1993 | Glaser | 187/355 |
| 7,137,484 | B2 * | 11/2006 | Martin | 187/354 |
| 7,287,627 | B2 * | 10/2007 | Eckenstein et al. | 188/137 |
| 7,299,898 | B2 * | 11/2007 | Husmann | 187/373 |
| 7,543,690 | B2 * | 6/2009 | Eckenstein et al. | 188/137 |
| 8,151,950 | B2 * | 4/2012 | Fargo | 188/164 |

* cited by examiner

*Primary Examiner* — Michael Mansen
*Assistant Examiner* — Michael Riegelman
(74) *Attorney, Agent, or Firm* — James G. Passé; Passé Intellectual Property, LLC

(57) ABSTRACT

The present invention relates to a braking apparatus and an elevator system comprising the braking apparatus for grasping or gripping a hoisting rope of the elevator. The system comprises a pair of brake shoes, a motorized rotatable camshaft with at least one cam surface for pressing against a push plate to compress a spring means and keep the shoes apart or when the motor is disengaged cause the cam shaft to not push on the push plate such that the springs expand cause the brake shoes to come together and grip the hoisting rope.

23 Claims, 5 Drawing Sheets

ELEVATOR CAR BRAKE

COPYRIGHT NOTICE

A portion of the disclosure of this patent contains material that is subject to copyright protection. The copyright owner has no objection to the reproduction by anyone of the patent document or the patent disclosure as it appears in the Patent and Trademark Office patent files or records, but otherwise reserves all copyright rights whatsoever.

BACKGROUND OF THE INVENTION

1. Field of the Invention

The present invention relates to an elevator braking device. In particular, it relates to a device designed as an emergency elevator brake which engages and prevents an elevator car from leaving an intended floor while the doors are open or under other emergency situation.

2. Description of Related Art

A wide variety of devices are movable in an up and down direction by means of a cable or wire rope. Elevator cars as well as buckets, harnesses and the like operate by means of a counterweighted motorized cable hoist means.

Elevators in particular are operated by suspending the car by one or more wire ropes. The wire rope then goes over a fulcrum, such as a traction sheave, and then down the other side of the fulcrum to a counterweight. Counterweighing an elevator car is useful in that less energy is necessary to move the elevator up and down in an elevator shaft. The elevator car, the fulcrum holding the cable, or both are motorized directly or indirectly usually through some form a geared mechanism. When the elevator is to stop at a particular floor, a brake is applied to stop and hold the elevator car in position for boarding and exiting.

Elevators have been equipped with brakes that are designed to act as an emergency backup in case of rapid decent of the elevator. For example, if the cable holding the car were to brake, the elevator car would rapidly descend to the bottom of the elevator shaft. Frequently, emergency brakes designed to grip 2 or more rails in the event of an elevator exceeding a predetermined speed have been included in elevator design.

There is a second emergency situation which exists during use of an elevator car. Because the counter weight of the elevator is usually heavier than the elevator car itself, a failure of the normal breaking device means the elevator car could easily over speed in an ascending manner. This could result in the car not remaining stationary at a given floor when the doors are open or cause the car to raise to the top of the shaft and remain stuck there. The code in the United States (and possibly soon in other countries) requires emergency brakes which engage in the event of such upward movement.

A number of methods are currently used to accomplish this task. Older methods include brakes applied to the fulcrum or traction sheave, to the hoisting ropes, the wire ropes, to the elevator car or to the counter weight via the counterweight guide rails. Brakes which include elements, such as hoses, tanks, air cylinders, compressors, or the like, are frequently subject to failure rendering the brake inoperative. One method of grabbing the wire rope is disclosed in U.S. Pat. No. 5,228,540 issued Jul. 20, 1993 to Glaser and assigned to the Hollister-Whitney Elevator corp. In their brake, there is a pair of brake shoes for grabbing the wire rope with a cam means connected directly to one of the shoes where the cam is a pivotal follower attached to the movable brake shoe moving across a stationary cam surface. The cam is activated by a compressed spring. While this design does work, it can stick in the open, non braking position if the cam shaft is broken. Further, since their cam is spring activated they rely on activation of a piston connected to the spring directly to work. Once again, if this brakes, the braking means will not operate.

Since such emergency brakes are mandated and must operate with the least amount of potential problems, it would be important to design an emergency brake for an elevator car system which overcomes some or all of the above problems with currently designed elevator brakes which can render them non operative.

BRIEF SUMMARY OF THE INVENTION

The present invention relates to a braking apparatus for gripping a hoisting rope of an elevator car. In particular, the present invention provides a motorized camshaft having a cam surface for moving a movable brake shoe away from a fixed brake shoe. The movable brake shoe is further controlled by a compressible spring means, which when the motor is not engaged causes the movable brake shoe to move toward a stationary brake shoe and grip a hoisting rope.

In particular, one embodiment of the invention is a braking apparatus comprising:

a) an inner brake shoe and an outer brake shoe, the shoes having facing braking surfaces and outer non-braking surfaces, the inner brake shoe being stationarily mounted and the outer brake shoe movably mounted such that the outer shoe braking surface can move toward the inner shoe braking surface;

b) a push plate having a first and second surface, the push plate connected in fixed relationship to the outer brake shoe and the first surface facing the brake shoes such that the first surface is closest to the non-braking surface of the inner brake shoe;

c) a compressible spring means positioned in between the push plate first surface and the non-braking surface of the inner brake shoe such that when the push plate is being pushed on the second surface toward the inner brake shoe the spring means is compressed and the outer brake shoe moves away from the inner brake shoe, and when the push plate is not being pushed on the second surface the spring means expands and pushes the push plate away from the inner brake shoe and the outer brake shoe moves toward the inner brake shoe; and d) a motorized rotatable cam shaft having a cam surface positioned such that when the motor is engaged, it rotates the cam shaft such that the cam surface pushes against the push plate second surface pushing it toward the inner brake shoe, compressing the spring means and moving the brake shoes apart and when the motor is not engaged, the cam shaft does not push on the push plate second surface.

In yet another embodiment of the invention, there is an elevator system comprising an elevator car, an elevator car hoisting apparatus which includes a hoisting rope and a braking apparatus for gripping the hoisting rope comprising:

a) an inner brake shoe and an outer brake shoe, the shoes having facing braking surfaces and outer non braking surfaces, the inner brake shoe being stationarily mounted and the outer brake shoe movably mounted such that the outer shoe braking surface can move toward the inner shoe braking surface;

b) a push plate having a first and second surface, the push plate connected in fixed relationship to the outer brake shoe and the first surface facing the brake shoes such that the first surface is closest to the non braking surface of the inner brake shoe;

c) a compressible spring means positioned in between the push plate first surface and the non braking surface of the inner brake shoe such that when the push plate is being pushed on the second surface toward the inner brake shoe the spring means is compressed and the outer brake shoe moves away from the inner brake shoe and when the push plate is not being pushed on the second surface, the spring means expands and pushes the push plate away from the inner brake shoe and the outer brake shoe moves toward the inner brake shoe and grips the hoisting rope; and d) a motorized rotatable cam shaft having a cam surface positioned such that when the motor is engaged, it rotates the cam shaft such that the cam surface pushes against the push plate second surface pushing it toward the inner brake shoe, compressing the spring means and moving the brake shoes apart and when the motor is not engaged, the cam shaft does not push on the push plate second surface.

Other embodiments of the invention will be clear from the disclosure drawings and claims which follow.

DETAILED DESCRIPTION OF THE INVENTION

Figure 1:
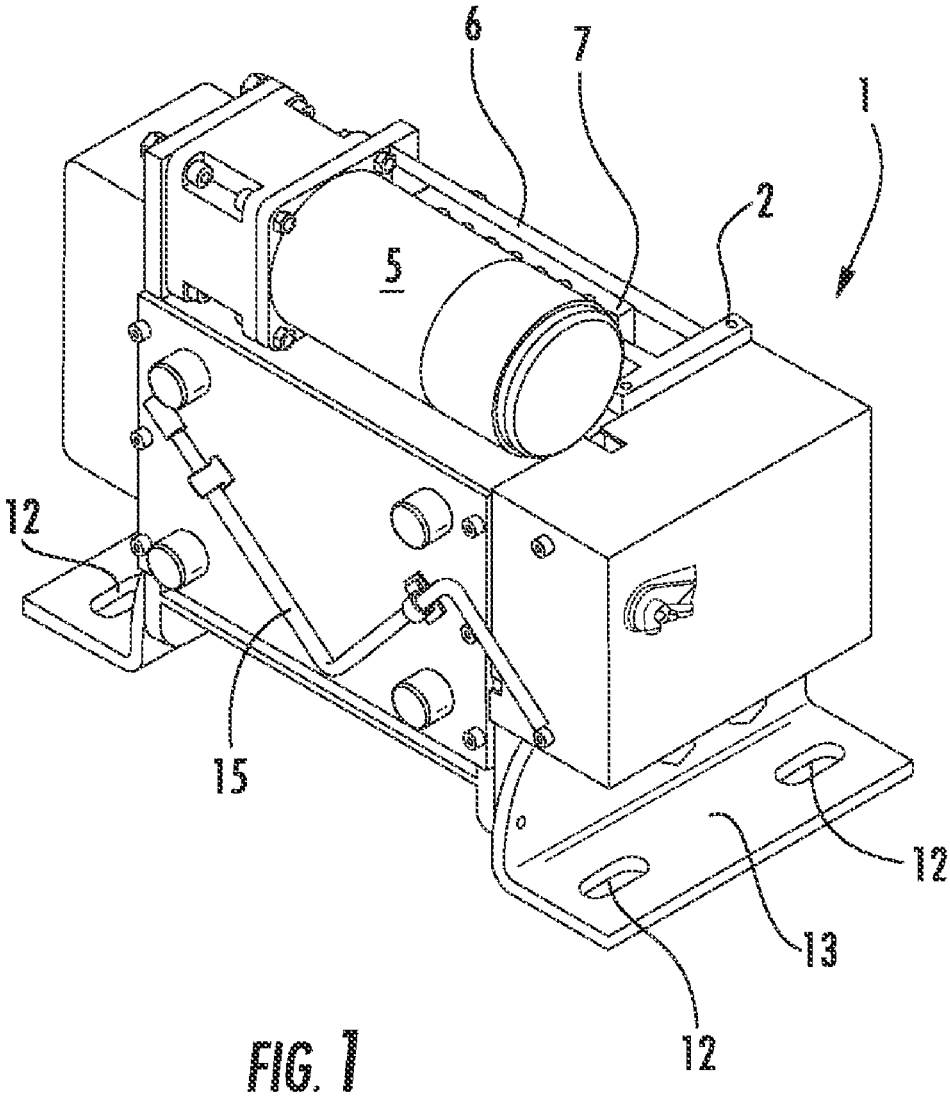
FIG. 1 is a perspective view of a brake of the present invention.

While this invention is susceptible to embodiment in many different forms, there is shown in the drawings and will herein be described in detail specific embodiments, with the understanding that the present disclosure of such embodiments is to be considered as an example of the principles and not intended to limit the invention to the specific embodiments shown and described. In the description below, like reference numerals are used to describe the same, similar or corresponding parts in the several views of the drawings. This detailed description defines the meaning of the terms used herein and specifically describes embodiments in order for those skilled in the art to practice the invention.

The terms "a" or "an", as used herein, are defined as one or as more than one. The term "plurality", as used herein, is defined as two or as more than two. The term "another", as used herein, is defined as at least a second or more. The terms "including" and/or "having", as used herein, are defined as comprising (i.e., open language). The term "coupled", as used herein, is defined as connected, although not necessarily directly, and not necessarily mechanically.

Reference throughout this document to "one embodiment", "certain embodiments", and "an embodiment" or similar terms means that a particular feature, structure, or characteristic described in connection with the embodiment is included in at least one embodiment of the present invention. Thus, the appearances of such phrases or in various places throughout this specification are not necessarily all referring to the same embodiment. Furthermore, the particular features, structures, or characteristics may be combined in any suitable manner in one or more embodiments without limitation.

The term "or" as used herein, is to be interpreted as an inclusive or meaning any one or any combination. Therefore, "A, B or C" means any of the following: "A; B; C; A and B; A and C; B and C; A, B and C". An exception to this definition will occur only when a combination of elements, functions, steps, or acts are in some way inherently mutually exclusive.

The drawings featured in the figures are for the purpose of illustrating certain convenient embodiments of the present invention, and are not to be considered as limitation thereto. Term "means" preceding a present participle of an operation indicates a desired function for which there is one or more embodiments, i.e., one or more methods, devices, or apparatuses for achieving the desired function and that one skilled in the art could select from these or their equivalent in view of the disclosure herein and use of the term "means" is not intended to be limiting.

As used herein, the term "inner brake shoe" and "outer brake shoe" refer to a pair of brake shoes designed to come together and grip an elevator hoisting rope. Each shoe has a braking surface and an opposing non-braking surface. Brake shoes generally consist of one or two pieces wherein on the braking side of each shoe there is braking material, brake pads, surfacing or other means for gripping a hoisting rope when the two facing pads braking surfaces come together on a hoisting rope. In the present invention, one of the brake shoes is stationarily mounted, for example, by attaching it to the entire device housing, or the like, and the second brake shoe is movable relative to the non-movable brake shoe. Then, in order brake only one shoe moves toward the stationary brake shoe until engaging the hoisting rope sufficiently to prevent the elevator car, which is being hoisted to remain stationary. The movable brake shoe is the outer brake shoe while the stationary brake shoe is considered the inner shoe. The brake shoes can be made of any convenient material, for example, they could consist of a metal plate with a brake pad attached to the braking surface of each pad. Asbestos or other materials are available within the art for such braking pads. The size of the pad can be determined by the grip necessary to grip the hoisting rope, in addition to the spring compressive force acting on the movable brake pad as described elsewhere herein.

As used herein, a "push plate" is a plate made of metal or other rigid strong material designed for a cam to push against. The push plate has a first surface and a second opposite surface. It is connected at a distance to the movable outer brake pad with the first surface of the push plate facing both brake pads. This can be done, for example, by using connecting rods. The outer brake pad would be attached to the connecting rods at one position and the push plate at another position at a given distance. By affixing each to the connecting rods or other attachment means, they are kept in fixed spacial relationship to each other. Thus, when the push plate is moved, the outer brake pad also moves in direct relationship in terms of distance, direction and speed. The push plate is designed to be pushed on the second surface by a cam surface directly and toward the non-braking surface of the inner brake pad in order to move the outer brake shoe away from the inner brake shoe, i.e., move the braking surfaces of the pads away from one another in order to not grip the hoisting rope. Positionally, the nearest surface of the brake shoes to the first surface of the push plate is the non-braking surface of the inner non movable brake shoe. The push plate, either directly or indirectly, when not pushed on the second surface, allows a compressible spring means to push on either the first surface of the push plate directly or push on a spring compression plate connected in register to the push plate and outer brake shoe. This creates a push on the push plate's first surface causing the movable brake shoe to move toward the first brake shoe and produce a gripping action as the two braking surfaces come together and grip a hoisting rope. With sufficient pressure, created by sufficient spring means force, the brake shoes will hold a hoisting rope tight, and thus, be capable of stopping an elevator car. This can be done directly by positioning a spring means pressing on the first side of the push plate, when the push plate is not being pushed or indirectly by mounting a spring compression plate or other means in fixed relationship to the push plate and using the spring means to push on that plate appropriately.

As used herein, "compressible spring means" refers to any device, material, or the like that when subjected to a compressive force will compress and when the compressive force is removed will have a tendency to return to the original position opposite the compressive force. Examples (but not a limited list) include coil or other compressible metal springs, compressible polymers, such as elastomers, and the like. In selecting the proper spring compression means one or more devices is selected such that the necessary force is generated on the push plate directly or a compression plate or the like to cause the movable brake shoe to move toward the non movable brake shoe sufficiently and with enough force to grip a hoisting cable. For example, a plurality of coil springs could be positioned for use. Depending on their compressive force, the proper number could easily be determined using the design parameters of the present invention brake. In one embodiment the compressible spring means is positioned touching the first surface of the push plate and the inner surface of the housing on which the inner brake shoe is mounted. In order to use smaller springs, a shorter course of compression, a spring compression plate, and the like, could also be used. The spring compression plate would be positioned in between the first surface of the push plate and the inner surface of the first housing wall on which the inner brake shoe is mounted. An example of such spring compression plate is shown in the figures and drawings which follow. By attaching the spring compression plate to the means for attaching the push plate to the outer brake shoe, the spring compression plate will move in fixed relationship in distance, speed and force of the push plate. In the embodiment where there is no separate spring compression plate, the push plate also acts as the spring means compression plate. Either way, when the push plate is pushed the push plate or a spring compression plate compresses the spring means while separating the two brake pads as described. The compressible spring means, when positioned properly, can also make use of a spring positioner. The spring positioner helps keep whatever is used as the compressible spring means in fixed relationship or alignment between the first housing wall inner surface and the spring compression plate during use of the brake apparatus. The compressive forces that are exerted on the compressible spring means could, in some embodiments, cause the compressible spring means to move laterally and thus, change the force with which they act. Use of the spring positioner device would prevent such accidental movement of the compressible spring means.

In order to push on the push plate in the present invention, a "motorized rotatable cam shaft having a cam surface" is used. A motor rotates the cam shaft to rotate the cam surface either against or away from the push plate and is normally powered by AC energy and capable of turning a cam shaft either directly or indirectly by a set of connecting gears. By using the set of gears, the motor can be positioned on top of a housing of the braking apparatus rather than next to the housing as would be the case for a normal straight line arrangement of a motor and rotating cam shaft. Note the figures which follow showing a motor on top with gearing. The motor is normally kept engaged during use in the on position. The engaged position delivers a rotational force to the cam shaft during normal non-emergency use and keeps the cam shaft in a position where the cam presses against the push plate sufficient to keep the brake not engaged. During an emergency or other situation which requires the brake to engage or the power is cut to the motor, the motor will stop running and thus, stop delivering a rotational force to the cam shaft. In one embodiment, the cam shaft will then rotate freely. The cam shaft has one or more cam surfaces. A cam surface is an eccentric part of the cam shaft and can act as a means to push the push plate with the enlarged part of the eccentric cam surface. It is rotated against the second surface of the push plate. When the motor is on, or otherwise engaged, the motor creates a positive torque on the cam shaft to rotate the cam surface (which can be a single or a plurality of eccentric areas on the cam shaft) on the cam shaft toward the push plate, push on the push plate a desired distance in order to keep the brake shoes from engaging the hoisting cable. The distance of the push is related to the size of the eccentricity of the cam surface and one skilled in the art can easily determine the proper size of the one or more cam surfaces in view of the disclosure herein. In other words, the motor would rotate the cam shaft a small distance, perhaps a quarter turn, and hold torque on that cam shaft as long as there was power. Thus, as long as there was power, the cam shaft would be turned, the cam surfaces would rotate against the second surface of the push plate and push on the push plate, thus moving the outer brake shoe away from the non-movable brake shoe and the brake shoes would remain separated as long as the cam was rotated against the second surface of the push plate. During the pushing process, the compressible spring means would be compressed due to the push plate or the spring compression plate pushing them in a compressible direction. In the event, a separate circuit indicated the need for the brake to engage, or in the event, the power is otherwise cut to the motor rotating the cam shaft, the motor disengages torque on the cam shaft, thus allowing the cam shaft to freely rotate at least to a position where the cam surfaces no longer push on the push plate (although they certainly could be just touching). Because the push plate has compressed the compressible spring means, when the motor was on and the cam surfaces pushing on the push plate compressed the spring means, the compressible spring means would then, when the motor is off, move to the relaxed uncompressed state, thus pushing the push plate away from the brake shoes. In this event, the springs would then also move the outer brake shoe toward the fixed brake shoe and cause the shoes to grip the hoisting rope. While this is happening the push plate would also push on the cam surfaces of the free rotating cam shaft and cause the free rotating cam shaft to be pushed back to its starting position before the motor was originally engaged. Therefore, during the cycling of the motor on and off, every time the motor would be engaged, the brake shoes would move apart and removing power to the motor would cause the brake shoes to come together in order to grip a hoisting rope. As brake shoes wear from use, the compressible spring means would automatically continue to move them closer together due to the force of the compressible spring means pushing the brake shoes together till resistance is achieved by the braking surfaces gripping a hoisting rope. A suitable wear indicator for the brakes could also be included, if desired in the present invention indicating when brake pads or other brake liners needed to be changed. In other embodiments, there is a manual means for causing the cam shaft to free rotate, even though the motor is engaged. This would be useful in emergency situations to cause the brakes to engage, when it is not possible to cut electricity to the motor or otherwise turn the motor off. This could be easily done by a means for disengaging the gears, which operate the cam shaft from the motor or other means as desired.

Now referring to the drawings, FIG. 1 is a perspective view of the brake of the present invention. The brake 1 is shown in operational perspective and as such an exploded view which follows will more particularly explain the invention. The brake 1 consists of housing 2 with cam shaft motor 5 sitting on top of housing 2. The outside brake 6 and brake pad 7 are shown. Elevator mounting holes 12 in mounting feet 13 are designed to attach the brake, where desired, in an entire elevator system as shown in the figures which follow. A disengagement lever tool 15 is shown, which can be removed from brake 1 and used to disengage the cam shaft from the motor 5 for the purposes of engaging the brake 6 manually without turning off electricity to the motor 5.

Figure 2:
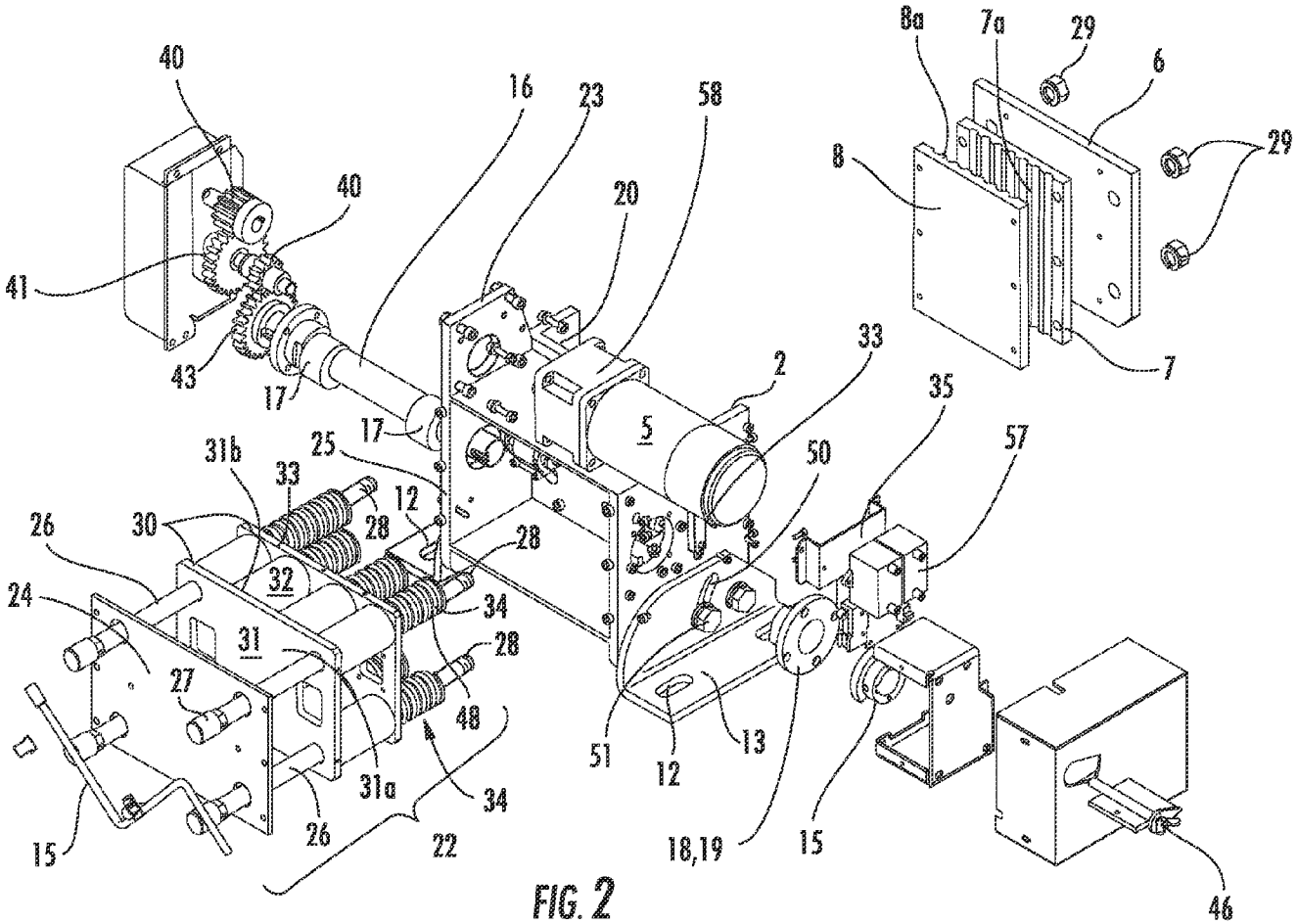
FIG. 2 is an exploded perspective view of an embodiment of the present invention.

FIG. 2 is an exploded view of an embodiment of the brake of the present invention. Outer brake shoe 7 is attached to outer movable brake 6. This can be accomplished by bolts or rivets or the like. The outer brake shoe 7 is movable during operation of brake device 1 as disclosed further on. Inner brake shoe 8 is fixed against housing 2 on the outer housing wall 20, once again by bolts, rivets or the like. The brake gripping surface 7*a* and corresponding 8*a*, when coming together during operation of the brake device 1, grip a cable of an elevator running between the 7*a* and 8*a* gripping surfaces.

Compression assembly 22 consists of several elements of the present invention and operates to move movable shoe 7 during operation. End plate 24 is mounted on housing 2 on the side opposite the outer housing wall along rear edges 25. Its function is to prevent anything from getting caught in the mechanism of the present invention and is not necessary, but merely an embodiment. The guide or alignment rods 26 are depicted, which are threaded through end plate 24, through inner housing wall 21 and out outer housing wall 20 and attach to brake 6. The guide rods 26 each have threaded ends 28 which attach to brake plate 6 by use of nuts 29. Stops 27 prevent the rods 26 from passing all the way through end plate 24, thus allowing the guide rods 26 to keep brake shoe 7 aligned with brake shoe 8 during movement of brake shoe 7. Push plate assembly 30 consists of push plate 31 having faces 31*a* and 31*b*, spring alignment tubes 32 and housing stop plate 33. Push plate assembly 30 is attached to the guide rods 26, and thus, when the assembly moves so does the movable brake shoe 7. As described later herein, the cam surface of a cam pushes on the push plate surface 31*a*. When the cam pushes on push plate 31, it causes the brake 6 to move away from the stationary brake shoe 8, and thus, release any grip on an elevator cable passing between the brake shoes 7*a* and 8*a*. When push plate is pushed it compresses springs 34, which are positioned between wall 21 and side 31*b* of the push plate and running inside tube 32 keeping each spring 34 aligned. Stop plate 33 prevents the springs 34 from being compressed passed the point when stop plate 33 hits wall 21. When the stop plate 33 hits wall 21, the springs are as compressed as they can go, and thus, the brake 6 is as far from the stationary brake 8 as possible. While a stop plate is not necessary, it prevents over compression of the springs and prevents separating the brake pads too far.

Motorized rotatable cam shaft 16 has a pair of eccentric cams 17. When the brake 1 is assembled, the cam shaft 16 is positioned in-between the push plate 31, and the end plate 24. When the cam shaft 16 rotates, the cams 17 rotate also and push against the push plate the distance of the eccentric portion of the cams 17. Thus, the brakes 6 and 8 separate the distance the cams 17 push the push plate 31 unless the stop plate 33 hits wall 21 first. Motor 5 sitting on top of housing 2 drives gear 40 which in turn drives gears 41, 42 and 43. Gear 43 is attached to rotatable cam shaft 16. Thus when the motor is engaged, it rotates the series of gears 40-43, and thus, rotates the cam shaft 16. This gear method enables the motor to be mounted on top of the housing 2 but it is clear that the gears could be eliminated and the motor 2 directly drive the cam shaft 16. It is clear that the cam shaft 16 need only rotate about a quarter turn to fully engage the cams 17 against the push plate 31. Two cams 17 are used to create an even push against the push plate 31, but it is clear that a larger or smaller number of cams 17 could be employed.

In the assembled position crank 15 can be attached to lever 46 and turned in order to manually turn the cam shaft 16 in an emergency or other desired condition. Angle adjustment slot 50 and holding bolt 51 allow the brake to be adjusted for mounting on a non-level surface. Lastly, relay 57 allows a signal to be sent to the motor 5 to engage or disengage. When engaged the motor 2 turns shaft 16 such that the cams 17 push the push plate 31 and separate the brakes. When the motor 2 is disengaged, the gears and the shaft turn freely and the push plate pushes on the cams 17 because of the springs 34 compression thus pushing the rotatable shaft 16 back to a starting position and closing the brakes on the cable, thus, holding a cable and an elevator connected to the cable in place.

Figure 3:
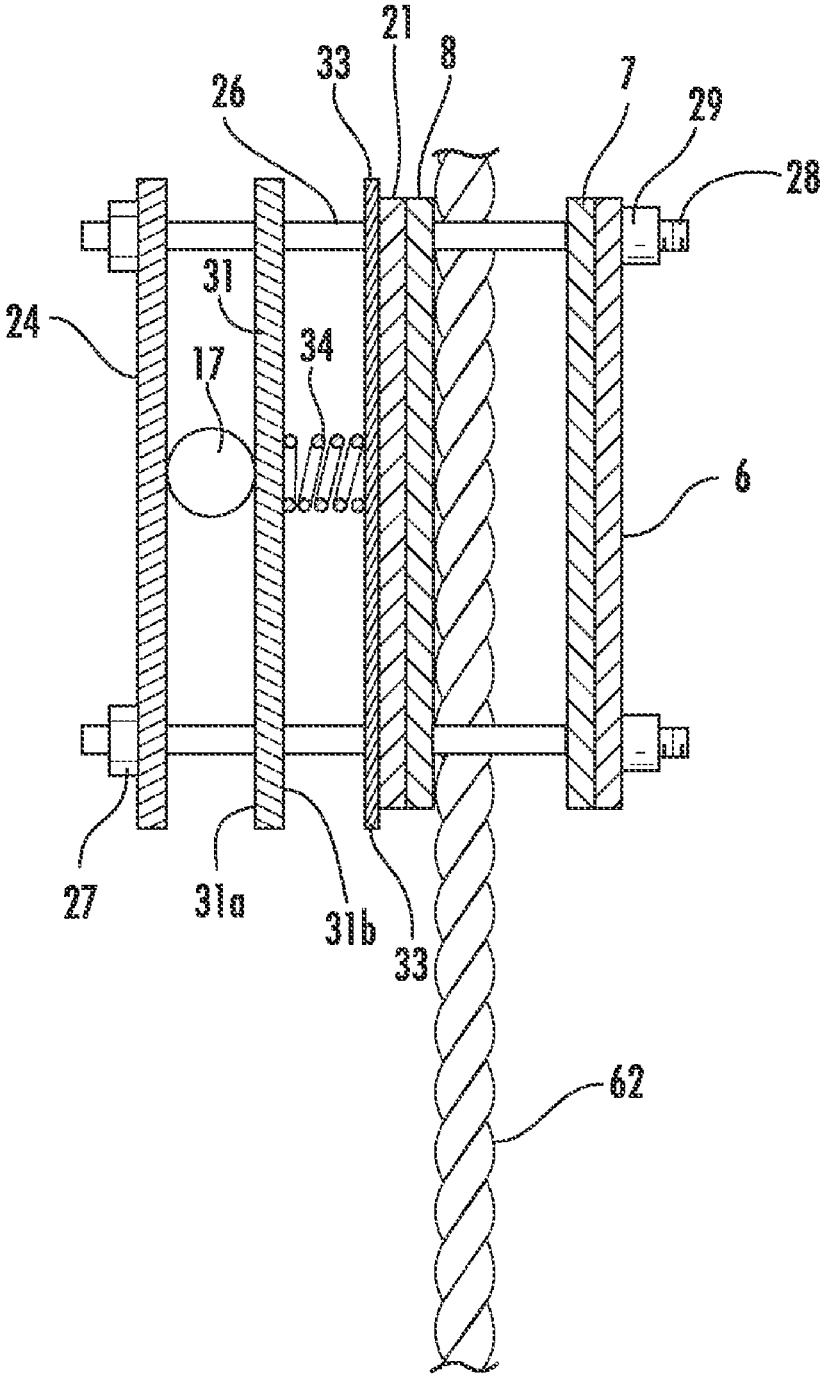
FIG. 3 is a side view of the braking mechanism with the cam surface engaged with the push plate.

FIG. 3 depicts a side view of the cam 17 operating to open the brakes. In this view, the cam 17 has rotated a little bit to press on push plate 31. By pushing on push plate 31, the spring 34 is compressed against wall 21 (passing through stop plate 33) and leaves the brakes 7 and 8 open to not grab elevator cable 62. The stop plate 33 in this view has come up against wall 21, and thus, cannot open the brakes 7 and 8 any farther.

Figure 4:
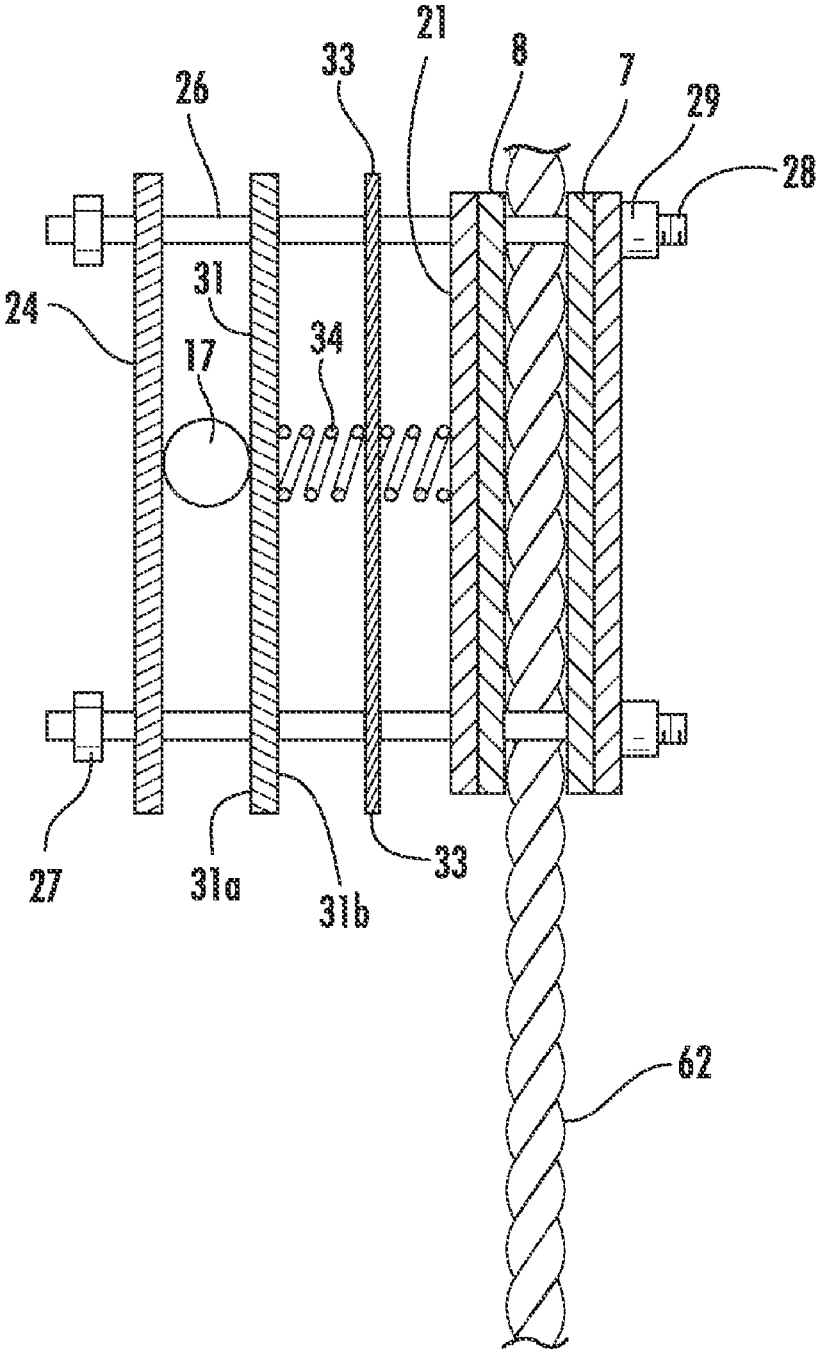
FIG. 4 is a side view of the braking mechanism with the cam surface not pushing on the push plate and gripping a hoisting rope.

FIG. 4 depicts the same side view of cam 17 as FIG. 3, however, in this view, the cam 17 has rotated just a bit so that it is not pushing on push plate 31. The spring 34 (depicted as a single spring) has pushed on push plate 31 on side 31*b* and moved the plate to the left of where it was in FIG. 3. Thus, the two brakes 7 and 8 have come close together and grab elevator cable 62 in the process. The grip of the brakes holds because of the constant pressure created by spring 34.

Figure 5:
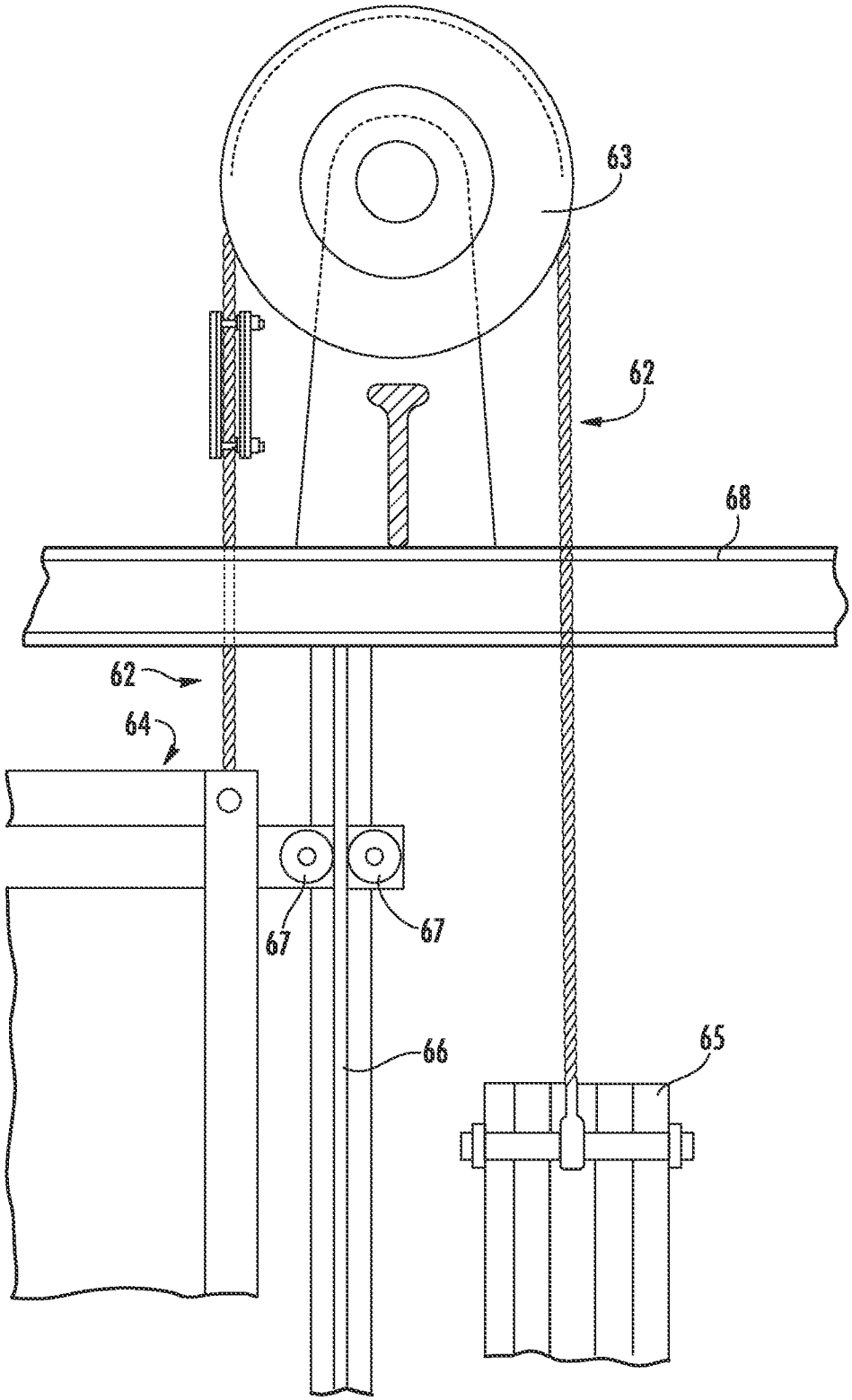
FIG. 5 is a view of the system of the present invention with the brake elevator car and hoisting mechanism depicted.

FIG. 5 depicts a side view of an elevator system comprising the brake 1 of the present invention. In this view, the brake is mounted to grip elevator cable 62 at any point the cable passes through the brake 1. The cable 62 is what holds the elevator car 64 at one side of the sheave 63. The cable 62 is also connected to a counterweight 65. The elevator car 64 is guided by use of rollers 67 and guide rails 46. While a single rope and devices are shown multiple ropes, brakes, guides, etc, could be employed. The sheave 63 along with the brake 1 are supported by elevator shaft beam 68, which is positioned on a fixed support means in an elevator shaft containing the system of the present invention.

What is claimed is:

1. A braking apparatus comprising:

a) an inner brake shoe and an outer brake shoe, the shoes having facing braking surfaces and outer non-braking surfaces, the inner brake shoe being stationarily mounted and the outer brake shoe movably mounted such that the outer shoe braking surface can move toward the inner shoe braking surface;

b) a push plate having a first and second surface, the push plate connected in fixed relationship to the outer brake shoe and the first surface facing the brake shoes such that the first surface is closest to the non braking surface of the inner brake shoe;

c) a compressible spring means positioned in between the push plate first surface and the non braking surface of the inner brake shoe such that when the push plate is being pushed on the second surface toward the inner brake shoe, the spring means is compressed and the outer brake shoe moves away from the inner brake shoe and when the push plate is not being pushed on the second surface the spring means expands and pushes the push plate away from the inner brake shoe and the outer brake shoe moves toward the inner brake shoe; and d) a motorized rotatable cam shaft having a cam surface positioned such that when the motor is engaged, the motor rotates the cam shaft such that the cam surface pushes against the push plate second surface pushing the push plate toward the inner brake shoe, compressing the spring means and moving the brake shoes apart and when the motor is not engaged the cam shaft does not push on the push plate second surface.

2. A braking apparatus according to claim 1 wherein the cam shaft has a plurality of cam surfaces.

3. A braking apparatus according to claim 1 wherein the rotatable cam shaft is rotated by one or more gears attached to the motor and holds the cam shaft with the cam surface against the push plate as long as there is power to the motor and when there is no power to the motor the rotatable cam shaft freely rotates.

4. A braking apparatus according to claim 1 wherein the outer brake shoe is connected to the push plate by a plurality of connecting rods.

5. A braking apparatus according to claim 1 wherein the inner brake shoe non-braking surface is mounted on an outer surface of a first housing wall having an inner and outer surface the housing inner wall facing the push plate first surface.

6. A braking apparatus according to claim 5 wherein the compressible spring means is mounted between the push plate second surface and the first housing wall inner surface.

7. A braking apparatus according to claim 5 wherein the compressible spring means is mounted in between the first housing wall inner surface and a spring compression plate positioned in-between the spring means and the second surface of the push plate wherein the spring compression plate is in fixed relationship to the push plate and outer brake.

8. A braking apparatus according to claim 4 and claim 5 wherein the spring compression plate is mounted on the connecting rods in fixed relationship to the push plate and the outer brake shoe.

9. A braking apparatus according to claim 1 wherein there is a manual means for free rotating the cam shaft while the motor is engaged.

10. A braking apparatus according to claim 1 wherein the compressible spring means is a plurality of metallic coil springs.

11. A braking apparatus according to claim 7 and 10 wherein there is a spring positioner for holding the compressible spring means in alignment between the spring compression plate and the first housing wall inner surface.

12. An elevator system comprising an elevator car, an elevator car hoisting apparatus which includes a hoisting rope and a braking apparatus for gripping the hoisting rope comprising:

a) an inner brake shoe and an outer brake shoe, the shoes having facing braking surfaces and outer non braking surfaces, the inner brake shoe being stationarily mounted and the outer brake shoe movably mounted such that the outer shoe braking surface can move toward the inner shoe braking surface;

b) a push plate having a first and second surface, the push plate connected in fixed relationship to the outer brake shoe and the first surface facing the brake shoes such that the first surface is closest to the non braking surface of the inner brake shoe;

c) a compressible spring means positioned in between the push plate first surface and the non braking surface of the inner brake shoe such that when the push plate is being pushed on the second surface toward the inner brake shoe the spring means is compressed and the outer brake shoe moves away from the inner brake shoe and when the push plate is not being pushed on the second surface, the spring means expands and pushes the push plate away from the inner brake shoe and the outer brake shoe moves toward the inner brake shoe and grips the hoisting rope; and d) a motorized rotatable cam shaft having a cam surface positioned such that when the motor is engaged the motor rotates the cam shaft such that the cam surface pushes against the push plate second surface pushing the push plate toward the inner brake shoe, compressing the spring means and moving the brake shoes apart and when the motor is not engaged the cam shaft does not push on the push plate second surface.

13. An elevator system according to claim 12 wherein the cam shaft has a plurality of cam surfaces.

14. An elevator system according to claim 12 wherein the rotatable cam shaft is rotated by one or more gears attached to the motor and holds the cam shaft with the cam surface against the push plate as long as there is power to the motor and when there is no power to the motor the rotatable cam shaft freely rotates.

15. An elevator system according to claim 12 wherein the outer brake shoe is connected to the push plate by a plurality of connecting rods.

16. An elevator system according to claim 12 wherein the inner brake shoe non-braking surface is mounted on an outer surface of first housing wall having an inner and outer surface in between the non-braking surface of the inner brake shoe and the push plate first surface, the inner surface of the housing facing the push plate first surface and the outer surface facing away from the push plate.

17. An elevator system according to claim 16 wherein the compressible spring means is mounted between the push plate second surface and the first housing wall inner surface.

18. An elevator system according to claim 16 wherein the compressible spring means is mounted in between the first housing wall inner surface a spring compression plate positioned in-between the spring means and the push plate first surface wherein the spring compression plate is in fixed relationship to the push plate and outer brake shoe.

19. An elevator system according to claim 15 and claim 16 wherein the spring compression plate is mounted on the connecting rods in fixed relationship to the push plate and the outer brake shoe.

20. An elevator system according to claim 12 wherein there is a manual means for free rotating the cam shaft while the motor is engaged.

21. An elevator system according to claim 16 where in the compressible spring means is a plurality of metallic coil springs.

22. An elevator system according to claim 18 and 21 wherein there is a spring holding means for holding the compressible spring means in alignment between the spring compression plate and the first housing wall inner surface.

23. An elevator system according to claim 12 wherein there is a motor for rotating the cam shaft positioned on the top of the braking apparatus and connected to the cam shaft by gears.

* * * * *